US006644636B1

(12) United States Patent
Ryan

(10) Patent No.: US 6,644,636 B1
(45) Date of Patent: Nov. 11, 2003

(54) CLAMP ADAPTER

(76) Inventor: M. Terry Ryan, 462 Main St., Biddeford, ME (US) 04005

( * ) Notice: Subject to any disclaimer, the term of this patent is extended or adjusted under 35 U.S.C. 154(b) by 0 days.

(21) Appl. No.: 10/005,413

(22) Filed: Oct. 26, 2001

(51) Int. Cl.[7] ..... B25B 1/00
(52) U.S. Cl. ..... 269/6; 269/156; 269/283
(58) Field of Search ..... 269/130–132, 269/156, 6, 238, 283; 81/421–423, 64, 65, 3.43, 302

(56) References Cited

U.S. PATENT DOCUMENTS

| | | | | | |
|---|---|---|---|---|---|
| 247,671 | A | * | 9/1881 | McKeever | 81/3.43 |
| 2,303,579 | A | * | 12/1942 | Ramoneda | 81/64 |
| 2,427,365 | A | | 9/1947 | Meister | |
| 2,474,940 | A | * | 7/1949 | Hansen | 81/423 |
| 2,766,649 | A | | 10/1956 | Labry, Jr. | |
| 3,292,922 | A | * | 12/1966 | Nastev | 269/131 |
| 4,834,352 | A | | 5/1989 | Thornton | |
| D302,654 | S | | 8/1989 | Cetrone | |
| 4,968,078 | A | | 11/1990 | Fitzwater | |
| D350,892 | S | | 9/1994 | Sorensen | |
| 5,411,244 | A | * | 5/1995 | Turner | 269/130 |
| 5,657,972 | A | | 8/1997 | Blatt | |
| 5,765,820 | A | | 6/1998 | Marusiak | |
| 5,863,033 | A | | 1/1999 | Bradford | |
| 6,161,823 | A | | 12/2000 | Bradford | |
| 6,202,272 | B1 | * | 3/2001 | Jackson | 81/64 |
| 6,328,295 | B1 | * | 12/2001 | Hanks | 269/130 |

* cited by examiner

*Primary Examiner*—Robert C. Watson
(74) *Attorney, Agent, or Firm*—Patricia M. Mathers; Thomas L. Bohan

(57) ABSTRACT

An adapter for modifying a spring clamp for use as an edge clamp. The adapter is essentially a flexible intermediate section with pockets attached at each end. Each pocket slips over one of the jaws of the spring clamp. When the clamp is forced open, the intermediate section extends from jaw to jaw across the jaw cavity of the clamp. When the clamp is placed over a workpiece, the intermediate section of the adapter deforms elastically around the contour of the workpiece that extends into the jaw cavity. The edge clamp exerts an edge-clamping force against the workpiece in a direction that is substantially perpendicular to the clamping forces exerted by the jaws and parallel to the longitudinal axis of the spring clamp.

8 Claims, 3 Drawing Sheets

CLAMP ADAPTER

BACKGROUND INFORMATION

1. Field of the Invention

The invention relates to the field of clamps. More particularly, the invention relates to the adaptation of spring clamps for use as edge clamps.

2. Description of the Prior Art

The hand spring clamp is a common tool for cabinetmakers and others who work with wood. It is rugged, inexpensive, readily available in hardware and other stores that sell tools, and available in a range of sizes. Most cabinetmakers have an assortment of these clamps, in various sizes. A typical example of such spring clamps is the PONY® clamp. These are simple tools comprising two lever arms pivotally connected to one another, with a sturdy coil spring located at the pivot point for urging the jaw ends of the clamp to close against each other. The clamps are without extraneous parts that can be misplaced or fall off, do not require adjusting to the thickness of the workpiece being clamped, and require only one hand to operate them, leaving the other hand free to hold the workpiece in position.

The conventional spring clamp is limited to applications in which clamping force is required only in a direction that is perpendicular to the longitudinal axis of the clamp. Many situations in woodworking, however, require the application of a clamping force in a direction coaxial with the longitudinal direction of the clamp. For example, the jaws of a spring clamp provide a clamping force against the upper and lower surfaces of a board, but do not provide a clamping force against the edge of the board, that is, against the surface of the board between the upper and lower surfaces. Either three-way C-clamps or long-bar or pipe clamps are typically used to provide this edge-clamping action. Both of these types of clamps have disadvantages in that they are time-consuming and tedious to use because they require that be properly tightened to provide the desired clamping action. Not only does manipulating the adjusting mechanism take time, but it also requires the use of both hands. Bar or pipe clamps also require access to opposite sides of the board to which edging is being applied.

Over the years, several attempts have been made to adapt the conventional hand spring clamp for use as an edge clamp. One such attempt is disclosed by U.S. Pat. No. 5,765,820 (Marusiak; issued 1998), which teaches the insertion of a flat spring into the conventional spring clamp. As the biasing spring forces the jaw ends of the clamp closed, the flat spring is forced into a curved shape that projects forward between the two jaws. This flat spring effectively applies a compressive force against the perpendicular edge of the horizontal surface being clamped by the spring clamp. The disadvantage of the Marusiak device is that, to be reliable and effective, the flat spring may have to be fastened within the clamp. This can be done by providing some type of riveted fastening, or a snap-fit mechanism formed by a protrusion on one part and a receiving hole or aperture on the other part. Once modified, the spring clamp is readily usable as an edge clamp, although it involves a certain amount of time and work to achieve the needed modification.

Other attempts have been made to adapt the spring clamp by permanently or semi-permanently mounting an edge-clamping mechanism onto the spring clamp. Generally, the clamping adaptations extend into the space between the jaw ends, thereby reducing the effective depth of the jaw. Such modified spring clamps are disclosed by U.S. Pat. Nos. 6,161,823 and 5,863,033, both issued to Bradford, in 2000 and 1999, respectively. Because the modification is permanent or semi-permanent, the cabinetmaker is required to have twice the number of normally required spring clamps, one set for use as the conventional spring clamps, a second set for use as edge clamps.

What is needed therefore is a quick and reliable method of and device for adapting a spring clamp for use as an edge clamp. What is further needed is such an adaptation that can also be quickly and easily removed so that the spring clamp may be returned to its conventional use. What is still further needed is such an adaptation that allows full use of the depth of the jaw cavity of the clamp.

BRIEF SUMMARY OF THE INVENTION

It is an object of the present invention to provide a device for modifying a conventional spring clamp for use as an edge clamp. It is a further object to provide such a device that is easily mounted and easily removed from the spring clamp. It is a yet further object to provide such a device that does not require any preparatory work on the spring clamp. It is a still further object to provide such a device that allows the clamp to be used to its full jaw cavity depth. An finally, it is an object to provide such a device that is inexpensive and increases the economic efficiency of the conventional spring clamp.

The objects are achieved by providing an edge-clamp adapter that slips over the jaw ends of the conventional spring clamp and provides a clamping action between the jaw ends in a direction coaxial with the longitudinal direction of the spring clamp and perpendicular to the clamping action of the jaw ends.

The edge-clamp adapter comprises essentially a flexible strip of material that is removably attached to the jaw ends of a hand spring clamp such that, when the spring clamp is opened, the flexible strip of material extends between the jaw ends across the clamp cavity. As the spring clamp is then applied to a workpiece to be clamped, the flexible material of the edge-clamp adapter fits or wraps around the contour of the workpiece, thereby providing a compressive force against the edge face of the workpiece that is between the surfaces gripped by the jaw ends of the clamp.

The edge-clamp adapter can be made of a variety of materials that are elastic or inelastic. The term "elastic material" is used herein to designate a material that is repeatably stretchable a distance that is at least a substantial portion of the length of the material and that rebounds substantially to its original dimensions. Suitable elastic materials include latex, gum rubber, neoprene, and other elastic materials, particularly those with good abrasion and tear resistance properties. Ideally, the elastic material has sufficient stretchability so that when the spring clamp is clamped about a workpiece that extends deep into the jaw cavity of the spring clamp, the elongation properties of the elastic material allow the clamp adapter to stretch around the workpiece without reaching its elastic limit.

The clamp adapter can be made entirely of elastic material, for example, or can have ends of a nonelastic or slightly elastic material that slip over or attach to the jaw ends by some fastening means, and an intermediate section of highly elastic material connecting the ends. The fastening means can include pockets that slip over the jaw ends, or a hook-and-loop type fasteners, wherein one part of the fastener is attached to the jaw ends and the mating part is attached to the ends of the clamp adapter. The possibilities for attaching the clamp adapter to the hand spring clamp are myriad. As long as those means are easily attachable to and easily removable from the hand spring clamp, and yet securely hold the clamp adapter in proper position on the clamp, they are suitable and are included within the scope of the present invention. The clamp adapter can also be made of a substantially inelastic material such as webbing. Because of the energy stored in a stretched elastic material, however, elastic material provides a greater and a more reliable clamping force than inelastic material and also provides greater adaptability to clamping needs. The description of the present invention will hereinafter refer to an elastic clamp adapter, although it is understood that a non-elastic clamp adapter is also included within the scope of the invention.

DETAILED DESCRIPTION OF THE INVENTION

Figure 1:
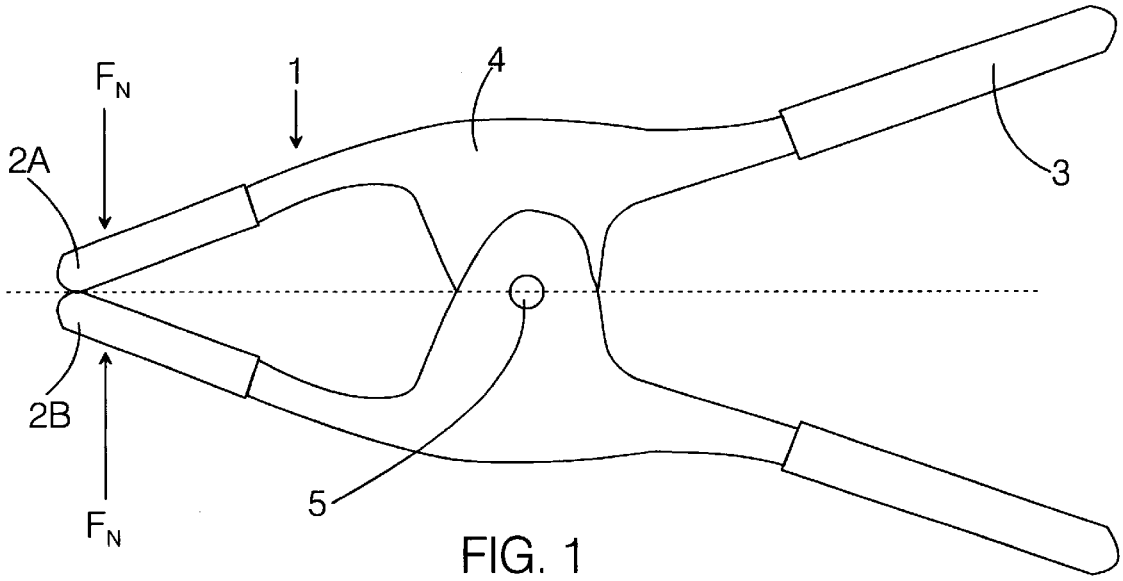
FIG. 1 (Prior Art)
FIG. 1 is a schematic view of a hand spring clamp (prior art).

FIG. 1 shows a conventional spring clamp 1 comprising two lever bars that are pivotally attached to each other by a pivot pin 5. The working end of the spring clamp 1 has two jaw ends 2A, 2B and at the opposite end of each jaw end is a gripper 3. A biasing spring 4 that urges the two jaw ends 2A, 2B toward each other is mounted around the pivot pin 5. The direction of force exerted by the two jaw ends 2A, 2B is indicated by the force arrows $F_N$.

Figure 2A:
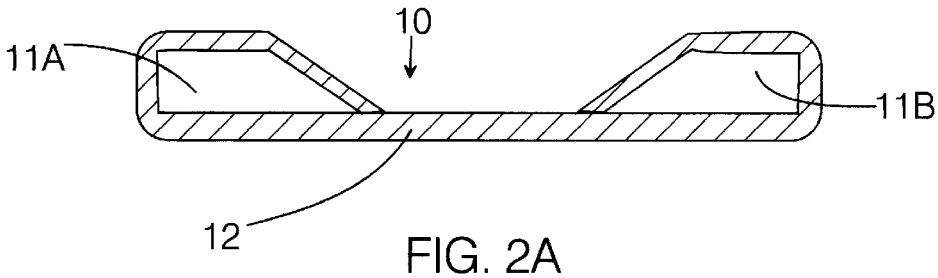
FIG. 2A is a perspective view of the Preferred Embodiment of the edge-clamp adapter according to the invention.
Figure 2B:
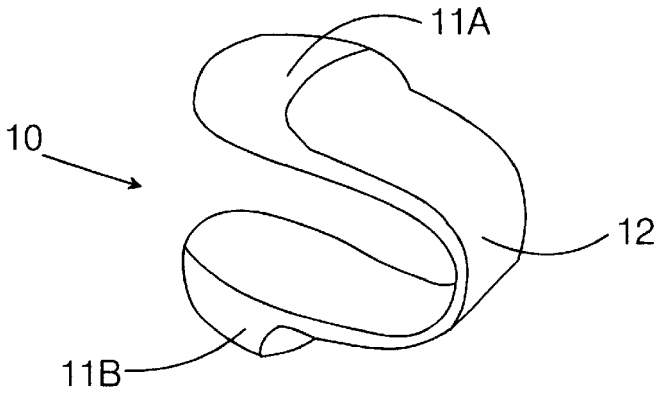
FIG. 2B is a cross-sectional view of the clamp adapter shown in FIG. 2A.

FIGS. 2A and 2B show perspective views of the Preferred Embodiment of the edge-clamp adapter 10 according to the present invention. The edge-clamp adapter 10 is formed as a single piece from an elastic material and comprises an intermediate section 12 and two jaw pockets 11A, 11B.

Figure 3A:
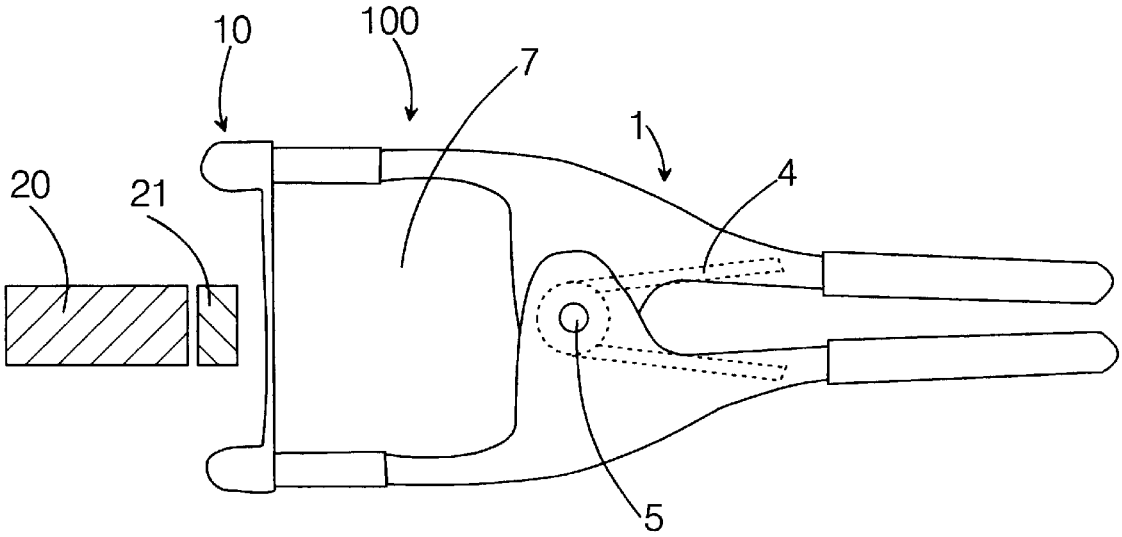
FIG. 3A is a schematic illustration of the Preferred Embodiment of the edge clamp and the base workpiece and edge workpiece that are to be clamped together.

FIG. 3A is a schematic illustration of an edge clamp 100 poised to clamp an edge workpiece 21 to a base workpiece 20. The edge clamp 100 includes the conventional spring clamp 1 and the edge-clamp adapter 10. The elements of the edge clamp 100 that correspond to elements of the spring clamp 1 and the edge-clamp adapter 10 previously shown are identified with the same reference designations. As can be seen, the edge-clamp adapter 10 has been arranged on the spring clamp 1 by slipping each jaw pocket 11A, 11B over a corresponding one of the two jaw ends 2A, 2B, whereby the intermediate section 12 extends across a jaw cavity 7 when the jaws of the spring clamp 1 are forced open. Also shown in FIG. 3A are the base workpiece 20 and the edge workpiece 21 that are to be clamped together.

Figure 3B:
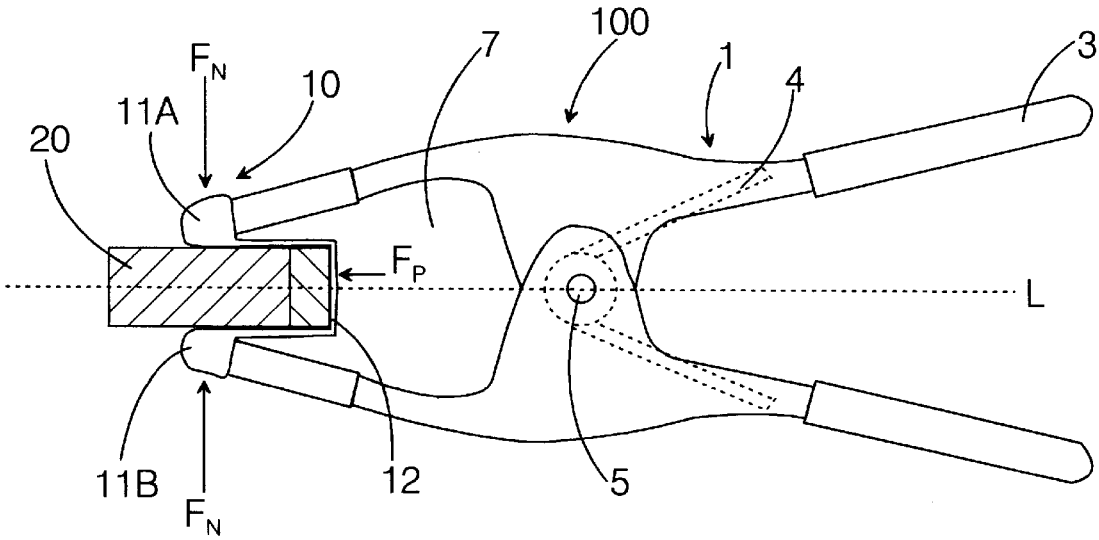
FIG. 3B is a schematic illustration of the Preferred Embodiment of the edge clamp clamping the edge workpiece to the base workpiece.

FIG. 3B shows the edge clamp 100 clamped around the edge workpiece 21 and the base workpiece 20. The intermediate section 12 of the edge-clamp adapter 10 has elastically deformed to fit the contour of the workpieces 20, 21 and firmly holds the edge workpiece 21 up against the base workpiece 20. The edge-clamp adapter 10 provides a clamping force that acts squarely on the edge workpiece 21, as indicated by an edge clamping force arrow $F_P$. The edge clamp 100 according to the invention is effectively a three-way clamp, similar in action to the conventional three-way C-clamp. The two jaw ends 2A, 2B provide opposing forces normal to the plane of the surface between the ends, as indicated by force arrows $F_N$ and the adapter provides a force perpendicular to the normal forces, in a direction coaxial to the longitudinal axis L of the edge clamp 100, as indicated by the force arrow $F_P$.

Figure 4:
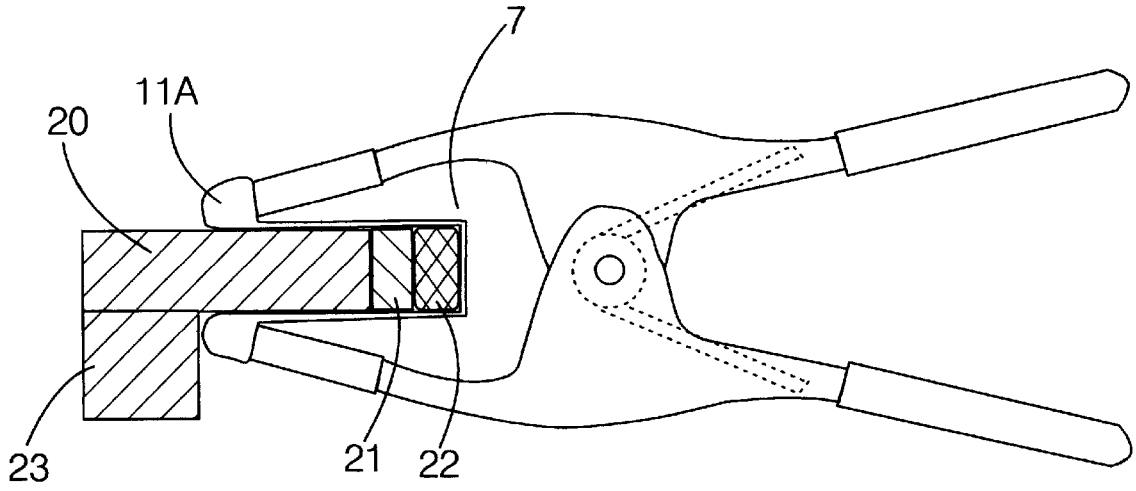
FIG. 4 is a schematic illustration of the Preferred Embodiment of the edge clamp, illustrating the use of a caul to clamp the edge workpiece to the base workpiece.

FIG. 4 shows the edge clamp 100 being used with a caul 22 as a spacer block in a situation when a surface of one or the other workpieces interferes with a full-depth placement of the edge clamp 100. In order to achieve the maximum clamping force $F_P$ against the edge workpiece 21, it may be desirable to place the edge clamp 100 on the base workpiece 20 such that the edge workpiece 21 is situated deep into the jaw cavity 7. The use of the caul 22 effectively stretches the intermediate section 12 of the adapter 10 to provide the maximum clamping force $F_P$.

Figure 5:
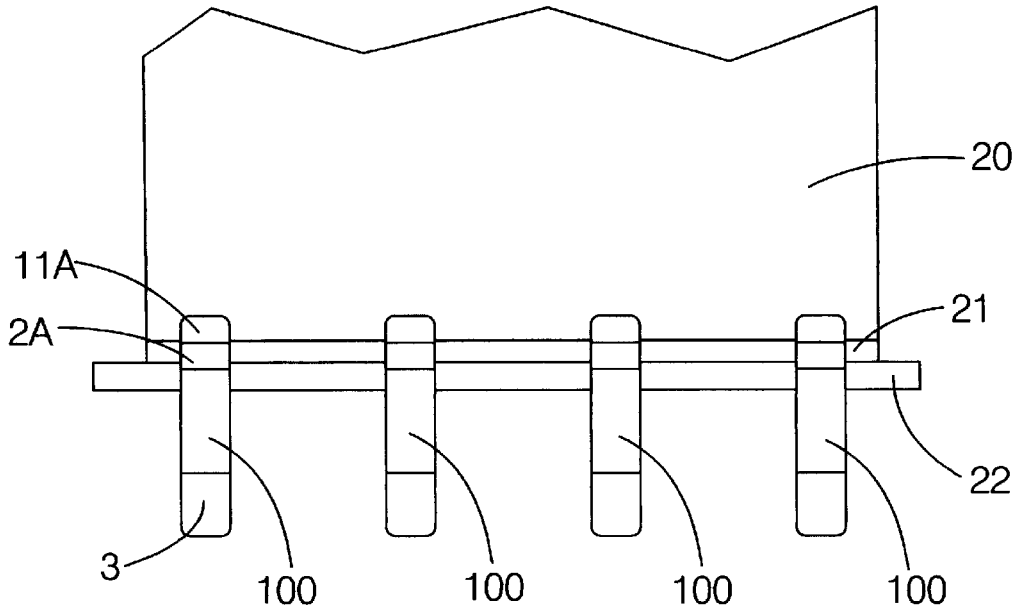
FIG. 5 illustrates the use of a long caul and a plurality of edge clamps according to the invention to clamp a long edge strip to a surface.

FIG. 5 is an illustration of the use of the caul 22 to clamp the edge workpiece 21 to the base workpiece 22 when one or the other of the workpieces is substantially longer than the width of the edge clamp 100. In this case, the caul 22 is a long spacer bar that aids in distributing the clamping force clamping force $F_P$ over the surface of the edge workpiece 21.

A plurality of clamp adapters 10 is also provided as a kit for use by woodworkers who already possess a number of hand spring clamps. The various clamp adapters 10 in the kit each have an elastic strength that varies from that of another one of the clamp adapters 10 in the kit. For example, the kit contains ten clamp adapters 10, two of which provide a strong clamping force $F_P$, two of which provide a light clamping force $F_P$, and six of which provide a medium clamping force $F_P$. Preferably, the individual clamp adapters 10 are color-coded or otherwise bear a mark or designation that indicates the strength of the particular adapter 10.

The Preferred Embodiment described herein is merely illustrative of the present invention. It should be understood that variations in construction and use of the present invention may be contemplated in view of the following claims without straying from the intended scope and field of the invention herein disclosed.

What is claimed is:

1. A device for adapting a spring clamp for use as an edge clamp, said spring clamp being of the type having two lever bars pivotally attached to each other by a pivot pin in a central area, and two clamping jaws, one each at a first end of a respective bar of said two lever bars, two grippers, one each at a second end of said respective bar, and a jaw cavity of a certain depth formable between said jaw end and said central area, wherein said spring clamp has a longitudinal axis that extends between said two clamping jaws, through a pivot point defined by said pivot pin, and said two clamping jaws provide mutually opposing normal forces against each other, said device comprising:

two adapter ends and an intermediate section therebetween;

wherein said intermediate section is essentially a strip of flexible material and each one of said adapter ends is removably attachable to a respective one of said two clamping jaws, and wherein said intermediate section forms a clamping means that exerts an edge-clamping force in said jaw cavity in a direction toward said two jaw ends, perpendicular to said mutually opposing normal forces of said jaw ends, and coaxial with said longitudinal axis; and wherein said adapter ends and said intermediate section are formed as a single piece from elastic material, wherein said two adapter ends are two pockets, and wherein each one of said two pockets slips over a respective one of said two clamping jaws.

2. The device of claim 1, wherein said intermediate section is made of elastically deformable material.

3. The device of claim 1, wherein said elastically deformable material is latex.

4. The device of claim 1, wherein said elastically deformable material is neoprene.

5. The device of claim 1, wherein said two adapter ends are made of a first material and said intermediate section of a second material.

6. The device of claim 5, wherein said first material is an inelastic material.

7. The device of claim 6, wherein said second material is an elastically deformable material.

8. The device of claim 1, wherein said intermediate section is made of a flexible webbing.

* * * * *